United States Patent [19]

Secrist et al.

[11] Patent Number: 4,626,333

[45] Date of Patent: Dec. 2, 1986

[54] ANODE ASSEMBLY FOR MOLTEN SALT ELECTROLYSIS

[75] Inventors: Duane R. Secrist, Elizabethton; James M. Clark, Johnson City; Henry E. Grindstaff, Memphis, all of Tenn.

[73] Assignee: Great Lakes Carbon Corporation, Briarcliff Manor, N.Y.

[21] Appl. No.: 823,438

[22] Filed: Jan. 28, 1986

[51] Int. Cl.[4] ..... C25C 3/12

[52] U.S. Cl. ..... 204/286; 204/243 R; 204/292

[58] Field of Search ..... 204/67, 243 R, 244–247, 204/279, 286, 291, 292; 264/60, 61, 104; 419/19, 31; 75/230, 232, 234, 246

[56] References Cited

U.S. PATENT DOCUMENTS

| | | | |
|---|---|---|---|
| 4,057,480 | 11/1977 | Alder | 204/290 R |
| 4,357,226 | 11/1982 | Alder | 204/243 R |
| 4,397,729 | 8/1983 | Duruz et al. | 204/293 |
| 4,430,189 | 2/1984 | Clark et al. | 204/290 R |
| 4,443,314 | 4/1984 | Secrist et al. | 204/243 R |
| 4,468,298 | 8/1984 | Byrne et al. | 204/292 |
| 4,514,268 | 4/1985 | De Angelis | 204/67 |
| 4,541,912 | 9/1985 | Secrist et al. | 204/290 R |

FOREIGN PATENT DOCUMENTS

| | | | |
|---|---|---|---|
| 81/0030834 | 6/1981 | PCT Int'l Appl. | 204/290 R |

*Primary Examiner*—Terryence Chapman
*Attorney, Agent, or Firm*—Adrian J. Good

[57] ABSTRACT

An anode assembly for an electrolytic cell for molten electrolysis has a cermet connector with a lower electrical resistivity than the anode threaded into the cermet or ceramic anode in the green or calcined state and then sintered to form an anode assembly having a low joint resistance at the cell operating temperature.

14 Claims, 5 Drawing Figures

ANODE ASSEMBLY FOR MOLTEN SALT ELECTROLYSIS

RELATED PATENTS

This application is related to U.S. Pat. No. 4,443,314 issued Apr. 17, 1984.

BACKGROUND OF THE INVENTION

Aluminum is produced in Hall-Heroult cells by the electrolysis of alumina in molten cryolite, using conductive carbon electrodes. During the reaction the carbon anode is consumed at the rate of approximately 450 kg/mT of aluminum produced under the overall reaction $$2Al_2O_3 + 3C \xrightarrow[Na_xAlF_6]{940°-1000° C.} 4Al + 3CO_2$$

The problems caused by consumption of the anode carbon are related to the cost of the anode consumed in the reaction above and to the impurities introduced to the melt from the carbon source. The petroleum cokes used in the anodes generally have significant quantities of impurities, principally sulfur, silicon, vanadium, titanium, iron and nickel. Sulfur is oxidized to its oxides, causing particularly troublesome workplace and environmental pollution. The metals, particularly vanadium, are undesirable as contaminants in the aluminum metal produced. Removal of excess quantities of the impurities requires extra and costly steps when high purity aluminum is to be produced.

If no carbon is consumed in the reduction the overall reaction would be $2Al_2O_3 \rightarrow 4Al + 3O_2$ and the oxygen produced could theoretically be recovered, but more importantly no carbon would be consumed at the anode and no contamination of the atmosphere or the product would occur from the impurities present in the coke.

Attempts have been made in the past to use non-consumable anodes with little apparent success. Metals either melt at the temperature of operation, or are attacked by oxygen or by the cryolite bath. Ceramic compounds such as oxides with perovskite and spinel crystal structures usually have too high electrical resistance or are attacked by the cryolite bath.

One of the problems arising in the developing of conductive ceramic anodes has been caused by the difficulty of making a durable electrical connection between the anode and the current conductor. Previous efforts in the field have produced connectors, primarily of metals such as silver, copper, and stainless steel. Can, U.S. Pat. No. 3,681,506, disclose a resilient metal washer held in place to form an electrical connection. Davies, U.S. Pat. No. 3,893,821, disclose a contact material containing Ag, La, $SrCrO_3$ and CdO. Douglas et al., U.S. Pat. No. 3,922,236, disclose a contact material containing Ag, Cu, La, and $SrCrO_3$. Fletcher, U.S. Pat. No. 3,990,860, disclose cermet compositions containing stainless steel or Mo in a matrix of $Cr_2O_3$ and $Al_2O_3$. Shida et al., U.S. Pat. No. 4,141,727, disclose contacts of Ag, $Bi_2O_3$, $SnO_2$ and Sn. Schirnig et al., U.S. Pat. No. 4,247,381, disclose an electrode useful for $AlCl_3$ electrolysis comprising a graphite pipe, a metallic conductor with a melting point below the bath temperature, and a protective ceramic pipe surrounding the former. West German No. 1,244,343, U.S. Ser. No. 729,621, discloses borides or carbides of Ti, Zr, Ta, or Nb cast of Al using a flux of $Li_3AlF_6$, $Na_3AlF_6$ and NaCl. Alder, U.S. Pat. No. 4,357,226, discloses an anode assembly for a Hall cell comprising individual units mechanically held together by a clamping arrangement.

There have been several lines of development concerning nonconsumable anodes, with ceramics such as stannic oxide compounds, spinels, perovskites and various cermets as principal materials under study. A cermet is a composite material containing both metal and ceramic phases. All of these need some method for connecting to the current conductor. Landon et al., U.S. Pat. No. 4,462,889, disclose a cermet composition for a non-consumable electrode of this type. Secrist et al., U.S. Pat. No. 4,472,258, disclose a non-consumable electrode with a gradient cermet composition. Secrist et al., U.S. Pat. No. 4,484,997, disclose a non-consumable anode with a diffusion-limited composition. Clark et al., U.S. Pat. No. 4,491,510, disclose a non-consumable electrode having a specific configuration. Secrist et al., U.S. Pat. No. 4,495,049, disclose an electrode with a specific gradient metal-cermet joint.

SUMMARY OF THE INVENTION

Our invention is an electrode assembly for use in molten salt electrolysis, particularly use for the production of aluminum in Hall-Heroult reduction cells. The assembly has a con-consumable anode, which is electrically connected to a current source, e.g., the anode riser bar, by a cermet stub. The anode can be mechanically supported by the cermet stub, or alternatively by mechanical suspension bars attached to he interior or exterior of the anode. The anode is preferably a conductive ceramic but may also be a cermet composition.

In one case, the anode is upported by mechanical suspension bars which engage slots in the inner wall of the anode. The slots are usually formed in the anode bars in the interior of the anode affording the bars greater protection from corroding fluoride vapors than attachment to the exterior of the anode. Anode packing is also more efficient with an interior support.

Since most ceramic oxides and cermets with low metal contents have steep negative temperature-resistance curves, i.e., the electrical resistances are higher at ambient than operating temperatures, the connection to the current conductor is preferably made in a region of high temperature to avoid severe ohmic losses in the anode. Metals, with the exception of costly precious metals, corrode at this high temperature and are therefore less desirable as candidates for connectors.

Our invention is an anode produced by an improved process with a cermet connector stub. Cermets generally have good electrical conductivity over a wide temperature range, being composed of metals with good conductivity at ambient and lower temperatures and of ceramics which, when carefully chosen and produced, can have good conductivity at high temperatures. Typically, cermets with at least 30 vol. % metal content exhibit conductivities approaching that of the metal phase while maintaining high corrosion resistance, provided that the cermet body is impervious, i.e., contains less than approximately 8 vol. % porosity, i.e. at least 92% of theoretical density. Cermets with from 15–50% vol. % metal may be useful as anode connectors, with at least 30 vol. % being preferred. Preferred metals are Cu, Ni, Fe, and alloys thereof as the metal phase of the cermet and as the metal component of the ceramic phase.

For use in a Hall-Heroult cell, a cermet must have good conductivity across a wide temperature range, good oxidation stability, and high corrosion resistance, particularly to fluoride fumes. When used as a connector, the cermet should have better conductivity at the operating temperatures than the anode. Metal-metal oxide combinations are desirable for use with oxide-based anode compositions for long term compatibility between the connector and the anode at the cell temperature. Cermets with a non-oxide ceramic phase may also be useful provided the oxide which forms on the surface of the cermet during operation at high temperature is sufficiently electrically conductive. A protective sheath may be placed over the cermet connector to provide additional protection from fluoride fumes.

The cermets are prepared conventionally by blending the ceramic powder with a metal. A cermet anode or connector may be formed by molding the ceramic and metal powder mixture at about $5\text{-}30\times10^7$ Pa, calcining the molded part at about 800°-1100° C., machining the part to a final shape, and sintering the machined part at a temperature above about 1100° C. effective to produce a physically strong part with low porosity, 8 vol. % or lower, and good electrical conductivity across a wide temperature range.

The connector may be joined to the electrode by a threaded joint, or by other designs affording positive physical and electrical contact.

Joint strength can be increased and interfacial electrical resistance can be reduced by the application of a thin metal coating to the connector to promote solid-state diffusion bonding between the anode and connector materials. The coating can be applied by a number of processes, e.g., plating or evaporation. The inventors have found that nickel, copper, and alloys of these metals are useful for this purpose. After coating, the connector is mated to the anode and heated to a temperature greater than the operating temperature of the Hall cell but below the melting point of the metal. The bonding takes place with the metal in the solid state and is distinguished from the potting operation traditionally used in aluminum cell technology which relies on the use of liquid metal to establish the joint current connection.

DETAILED DESCRIPTION OF THE INVENTION

Figure 1:
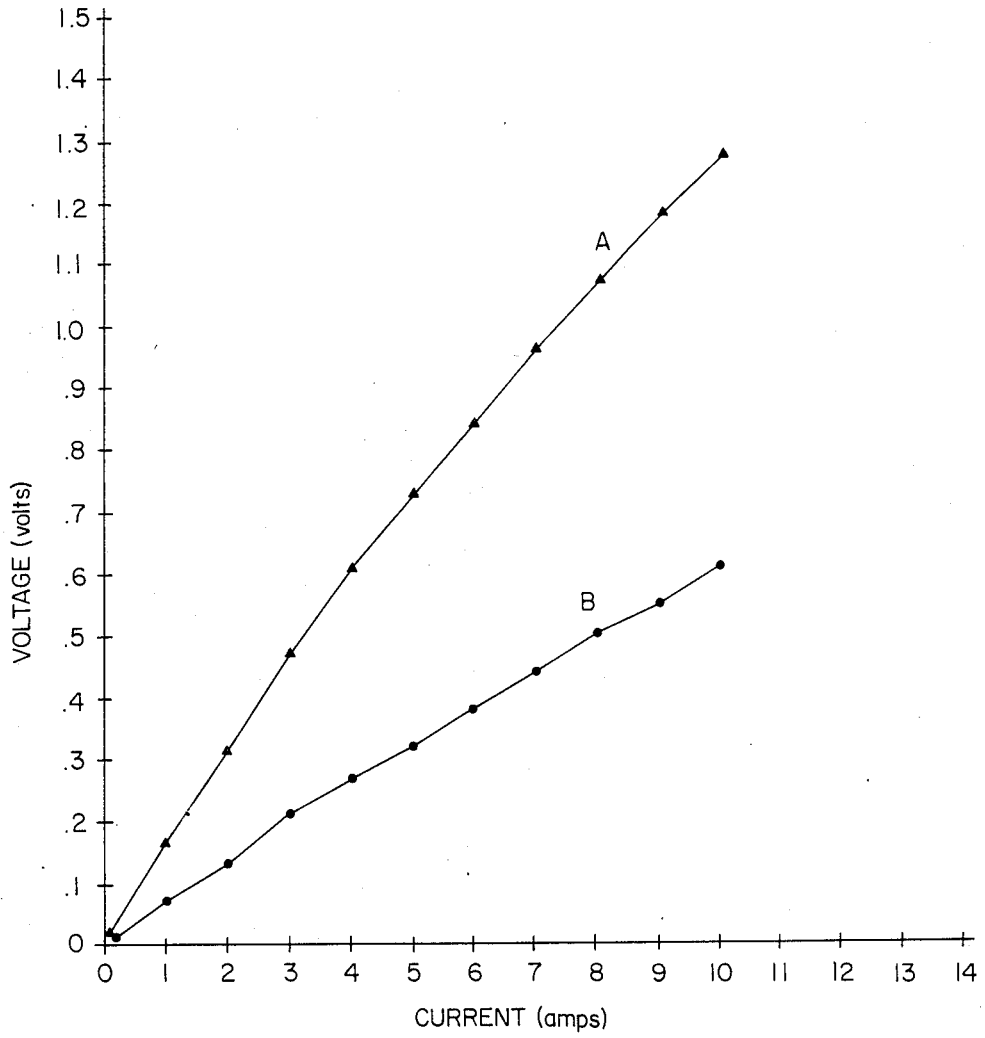
FIG. 1 shows current versus voltage profiles for the anode/connector assembly of Example 2 (curve A) and for a solid MnZn ferrite sample (curve B) over the range of 0-10 amps.

Cermets comprising Ni ferrite or MnZn ferrite and 16-40% by volume Ni were fabricated. The ferrite powders used in this study were prepared by conventional wet milling of $MnCO_3$, ZnO, and $Fe_2O_3$ or $NiCO_3$ and $Fe_2O_3$. The dried powders were calcined in air at 1000° C. for two hours to yield a final composition corresponding to 52 mole % $Fe_2O_3$, 25 mole % MnO, and 23 mole % ZnO or 52 mole % $Fe_2O_3$ and 48 mole % NiO. The cermet compositions were mixed by dry blending the ferrite powders with 40 micron size (−325 mesh) or 1-5 micron size nickel powder. Samples were then isostatically pressed and sintered in vacuum or nitrogen for 2-24 hours at 1225°-1350° C. to produce dense, low porosity, articles.

Two types of anode-connector assemblies were constructed (1) a cermet connector mated to a ceramic anode, and (2) a cermet connector mated to a cermet anode. Components for the first type of assembly were constructed using MnZn ferrite for the anode and a 16/84 vol. % Ni/MnZn ferrite for the cermet connector. The components were molded at 69 to $138\times10^6$ Pa (10 to 20 psi$\times10^3$), calcined for two hours in vacuum at 800°-1100° C., preferably 1025° C., machined, then sintered for two hours in vacuum at 1225° C. The measured shrinkages in going from the calcined to the sintered stage were as follows:

| Material | Molding Pressure | % Shrinkage Axial | % Shrinkage Radial |
|---|---|---|---|
| MnZn Ferrite anode | $138\times10^3$ Pa ($20\times10^3$ psi) | 14.5 | 14.5 |
| MnZn Ferrite anode | $103\times10^6$ Pa ($15\times10^3$ psi) | 15.6 | 15.7 |
| Ni/MnZn Ferrite connector | $103\times10^6$ Pa ($15\times10^3$ psi) | 10.0 | 10.2 |
| Ni/MnZn Ferrite connector | $69\times10^6$ Pa ($10\times10^3$ psi) | 11.6 | 11.4 |

We have found that by calcining the parts at an intermediate temperature, e.g., 1025° C., the parts are readily machinable without breakage and have controllable shrinkage during the sintering step at the higher temperature. Alternatively, acceptable machinability in the green state can be obtained by isostatic molding at much higher pressures, e.g., $28\times10^7$ Pa ($40\times10^3$ psi).

Components for the second type of assembly were constructed using 16/84 vol. % Ni/Ni ferrite for the anode and 40/60 vol. % Ni/Ni ferrite for the cermet connector. The components were molded at $138\times10^6$ PA ($20\times10^3$ psi), machine threaded 5.5 threads/cm (14 threads per inch) in the green state, and then sintered for twenty-four hours in nitrogen at 1350° C.

EXAMPLE 1

A 3.5 cm ($1\frac{3}{8}$ in.) diam. MnZn ferrite anode and a 1.9 cm ($\frac{3}{4}$ in.) 16/84 vol. % Ni/MnZn ferrite cermet pin connector were molded at $138\times10^6$ Pa ($20\times10^3$ psi) and $69\times10^6$ Pa ($10\times10^3$ psi), respectively, to minimize differences in shrinkage, as shown above. The calcined anode was machine threaded 4.3 threads per cm (11 per in.) and the calcined cermet pin was threaded 4.5 threads per cm (11.5 per in.). The sintered pieces had final threads about 5.1 threads per cm (13 per in.). The densities of the components were at least 95% of theoretical. The electrical resistivities of the MnZn ferrite and cermet materials were measured as 0.09 ohm-cm and 0.03 ohm-cm, respectively, at 950° C. in air.

The pin was threaded into the anode and the electrical and mechanical stability of the joint and the total assembly tested by electrolyzing the assembly for 24 hours at 968° C. in a Hall electrolyte consisting of 81% cryolite, 5% $AlF_3$, 7% CaF2, and 7% $Al_2O_3$ by weight. An electrolysis current of 15.3 amps applied to the cermet connector gave a current density of 1.0 amps/cm$^2$ at the tip of the anode and 5.4 amps/cm$^2$ within the cermet pin. The cell voltage was stable throughout the test, an indication of high joint stability, and the sample was intact when removed from the cell.

EXAMPLE 2

The electrical contact resistance of an anode/connector assembly comprising a 16/84 vol. % Ni/MnZn ferrite cermet pin threaded into a MnZn ferrite ceramic anode was measured at 950° C. in air. The procedure was as follows: Two MnZn ferrite cylindrical samples, each 5.08 cm long$\times$4.45 cm in diameter, were prepared for the measurement, one in solid form to be used as a standard (zero internal contact resistance) and the other drilled and threaded to accommodate a 1.9 cm diameter threaded cermet pin. The cermet pin was threaded into the ceramic piece flush with the surface of the ceramic so that both the test sample and the standard sample had the same external dimensions. Platinum contacts were fired onto the ends of the specimens; platinum leads in a 4-probe configuration were used for the electrical connections.

The current-voltage profile of each sample was measured over the current range 0–10 amps-equivalent to a current density of 0–3.5 amps/cm$^2$ in the cermet pin and 0–0.7 amps/cm$^2$ in the ceramic. The profiles are plotted in FIG. 1. With the measurement scheme described, the contact resistance of the threaded joint at a given current is equal to the resistance of the threaded test sample minus the resistance of the standard sample. At 0.1–0.2 amps the joint resistance was 0.090 ohms, while at 10 amps the resistance was 0.065 ohms.

These values are higher than desirable for commercial application. Lower joint resistance can be obtained by (1) careful matching of the thread size, thread pitch, etc., or (2) through the use of an interfacial metal contact. In the latter case the metal should have a melting point greater than the Hall cell operation temperature, which is typically 950°–960° C. The metal contact is afforded protection from the corrosive effects of the cell environment by the threaded joint. The thickness of the metal contact should be limited to avoid stresses induced by thermal expansion mismatch. This can be achieved, e.g., by plating the cermet connector or by placing a small amount of metal in the threaded anode cavity prior to assembly of the cermet pin at elevated temperature. On assembly at the temperature sufficiently above the cell operating temperature to melt the metal contact, the molten metal is forced along the connector threads to effect, on cooling, a solid-state connection with high contact area. Copper-nickel alloys have been found useful for this purpose.

EXAMPLE 3

Figure 2:
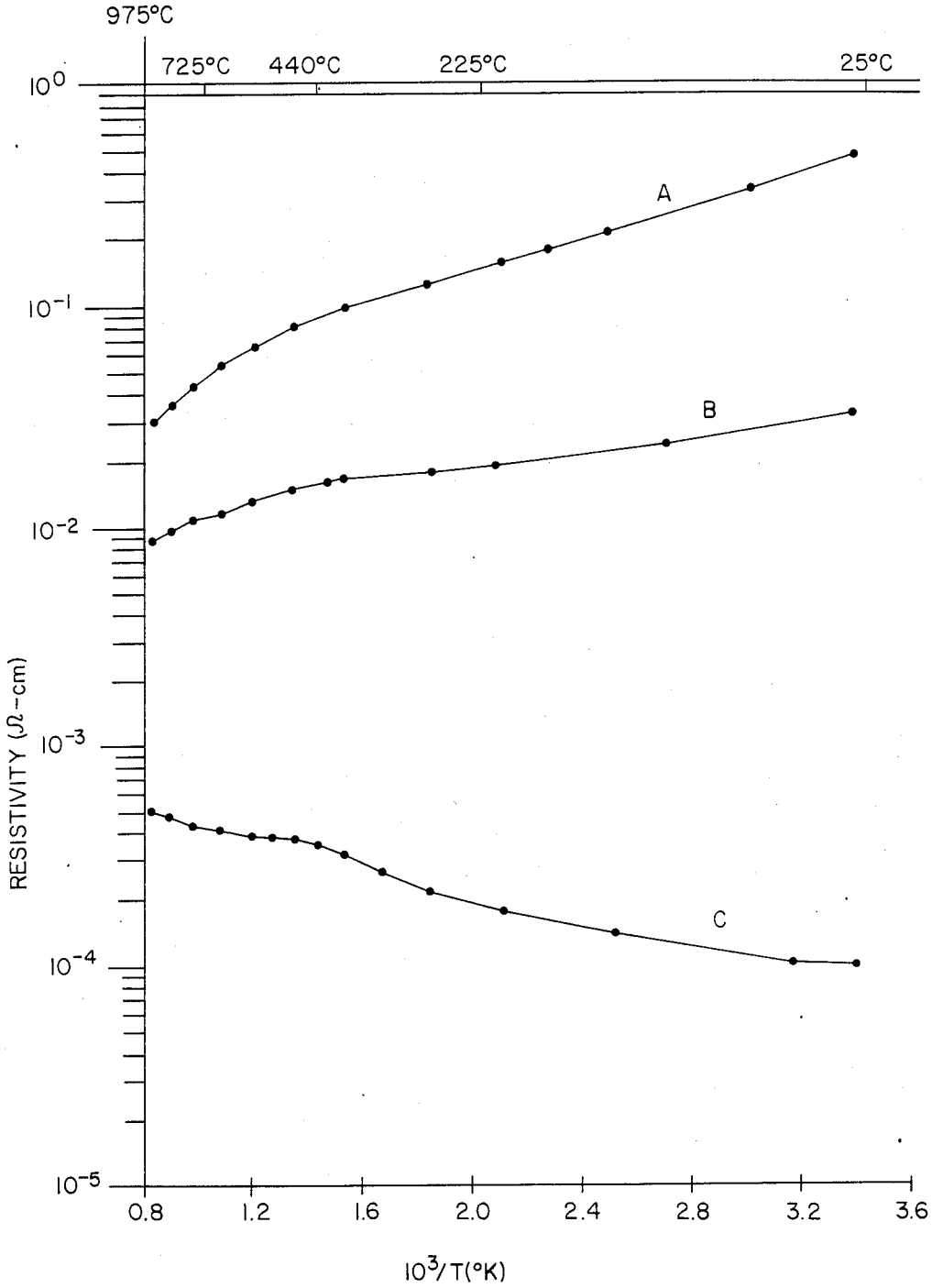
FIG. 2 is a plot of log resistivity vs reciprocal temperature for (A) 16 vol. %, (B) 25 vol. %, and (C) 40 vol. % Ni/MnZn ferrite cermets of Example 3.
Figure 3:
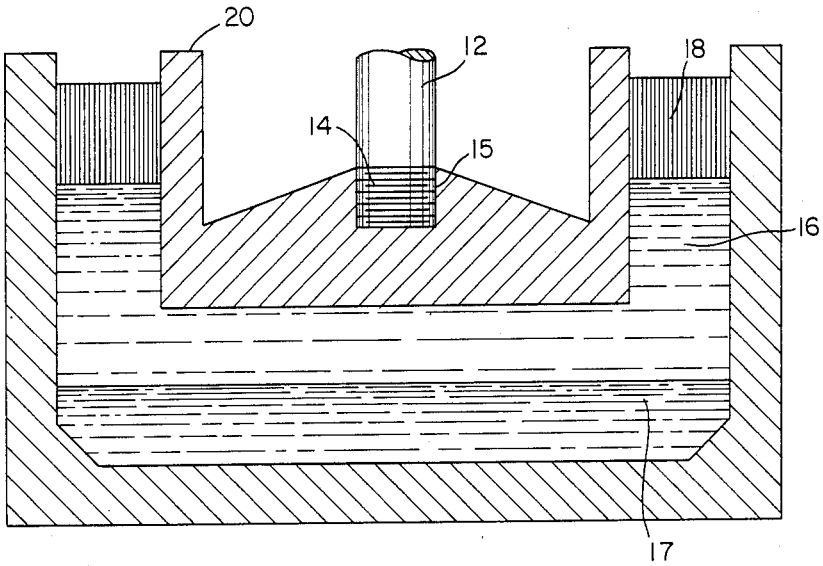
FIG. 3 illustrates one embodiment of the anode in operation in a Hall cell, using a threaded connector. The anode body 10 is held in place by threaded electrical connector 12, which may optionally have the threaded portion 14 wetted by a metal 15 with a melting point above the cell operating temperature. The anode is immersed in the Hall electrolyte 16 through the cell crust 18, with molten Al pool 17.
Figure 4:
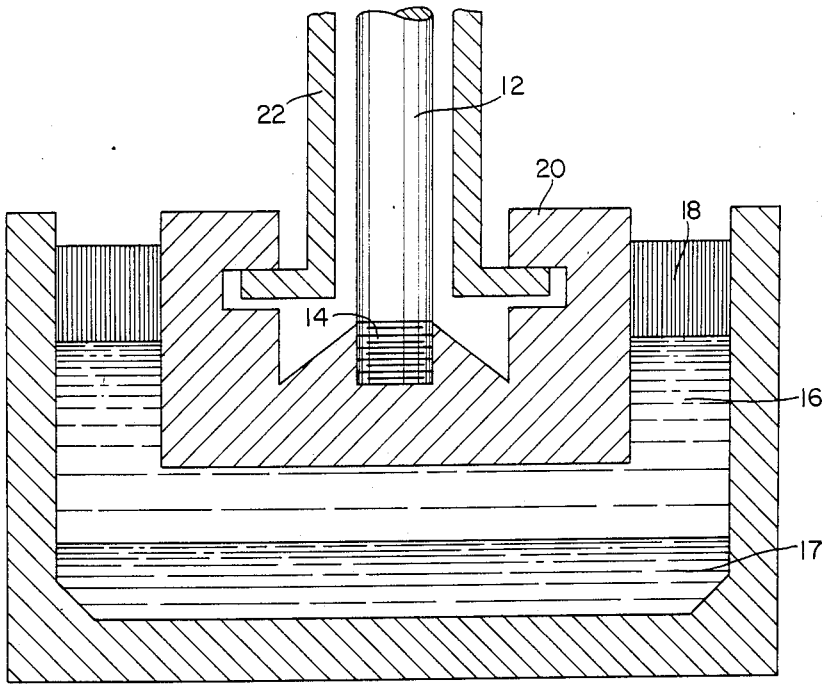
FIG. 4 illustrates a second embodiment of the invention wherein anode body 20 is held in place by mechanical suspension bar 22. In this instance the cermet connector is primarily a current conductor with the anode mechanically suspended by the suspension bar. The connections of the mechanical suspension to the structure and of the anode connector to the current source are conventional. The current distribution within the anode is improved by the tapered region shown in the lower anode cavity.

Cermet samples containing 16, 25 and 40 volume % Ni and the remainder MnZn ferrite were fabricated for electrical resistivity characterization. Measurements were taken over the temperature range 25°–950° C. using platinum probes and contacts in a 4-terminal arrangement. A plot of log resistivity versus reciprocal temperature for the cermets is shown in FIG. 2. The measurements were made in air. It is evident from the figure that the compositions containing 16 and 25 volume % Ni have negative temperature coefficients, characteristic of semiconducting oxides, while the 40 volume % Ni cermet has a positive temperature coefficient, indicative of metallic behavior. The internal stability of all three cermets at 950° C. in air was demonstrated by noting that the resistivities remained constant for periods at least 40 hours. The cermet containing 40 volume % Ni has a resistivity at 950° of $5\times10^{-4}$ ohm-cm, one-tenth that of anode carbon at the same temperature. A polished specimen of this cermet was examined with the electron microscope and observed to be very dense and to possess an extended internal metal network accounting for the metallic electrical properties. This composition offers the lowest resistance for application as a cermet connector.

EXAMPLE 4

Two cermet anode/connector assemblies were fabricated for joint resistance measurements. Both comprised a 40/60 vol. % Ni/Ni ferrite cermet connector threaded into a 16/ 84 vol. % Ni/Ni ferrite cermet anode. In one case the cermet connector and cermet anode were fabricated and sintered separately prior to assembly. In the other case the cermet connector and cermet anode were fabricated, assembled in the green state, and sintered together. The current-voltage profile of each assembly was then measured for comparison.

The anode portion of the sintered assemblies was 5.5 cm long$\times$4.0 cm in diameter and accommodated a 1.9 cm diameter cermet connector with 4 threads/cm. In each case the cermet connector was threaded into the anode until the bottom of the connector contacted the anode. The overall physical dimensions of the anode/-connector assemblies were equivalent.

Figure 5:
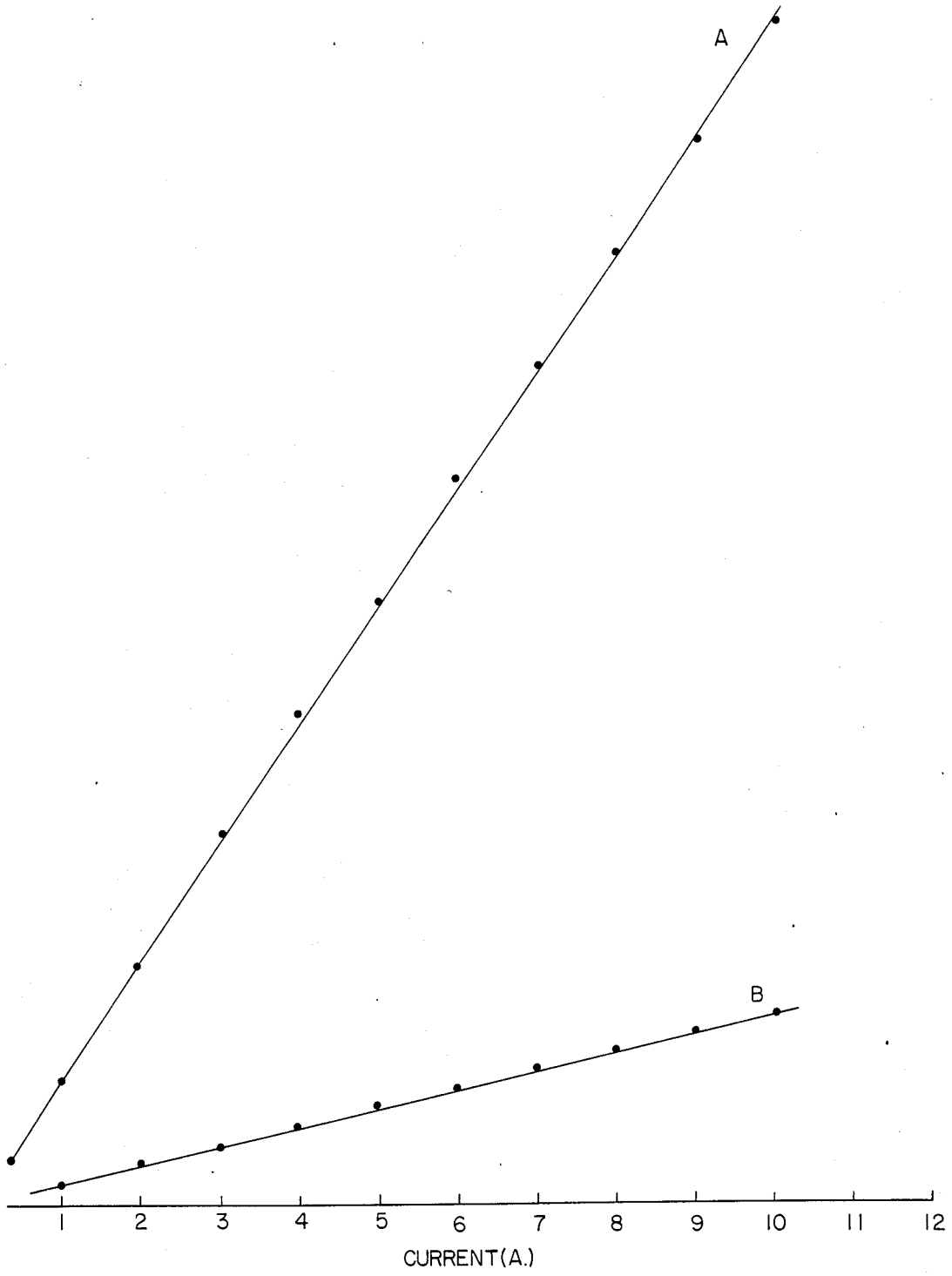
FIG. 5 shows current versus voltage profiles for the anode/connector assemblies of Example 4 wherein the components are assemblied after sintering (curve A) or prior to sintering (curve B).

Platinum leads in a 4-probe configuration were used for the electrical connections. Platinum contacts were fired onto the assemblies. Two current leads were positioned at the ends of the assemblies, while two voltage leads were positioned 2 cm above and 2.5 cm below the anode/connector joint interface. The currentvoltage profile of each assembly was measured over the current range 0–10 amps-equivalent to a current density of 0–3.5 amps/cm$^2$ in the cermet connector and 0–0.8 amps/cm$^2$ in the cermet anode. The profiles are plotted in FIG. 5. Curve A shows the currentvoltage profile for the anode/connector assembly formed by threading two separately sintered components together, whereas curve B shows the profile for the anode/connector assembly threaded together in the green state prior to sintering. The voltage operating levels observed in FIG. 5 for the cermet assemblies (cermet anode/cermet connector containing 40 vol. % metal) are markedly lower than those shown in FIG. 1, curve A, which were obtained with a ceramic anode mated to a cermet connector containing 16 vol. % metal. From FIG. 5 it is seen that a 6X reduction in threaded joint resistance can be achieved if the connector and anode are assembled and sintered together.

EXAMPLE 5

A 100% nickel powder sample, ca. 1" dia.×2.5" long was formed by isostatic pressing at $14\times10^7$ Pa. The circumferential area of this sample was then overcoated with a 0.64 cm thick cermet composition having 40% by volume nickel powder and 60% by volume MnZn ferrite in a secondary pressing step at $20\times10^7$ Pa. The composite sample was sintered at 1225° C. in vacuum to yield a dense part free from cracks. Sectioning revealed that a continuous diffusion bond was formed between the nickel core and cermet coating.

We claim:

1. An anode assembly for an electrolytic cell for molten salt electrolysis comprising a cermet connector and a cermet or ceramic anode, the connector having a lower electrical resistivity than the anode at the operating temperature of the cell, wherein the connector and anode are mated together in the green or calcined state and then sintered to produce said assembly having a low resistance joint.

2. The assembly of claim 1 wherein the connector and the anode are mated by a threaded connection.

3. The assembly of claim 1 wherein the metal phase of the cermet is a metal selected from the group consisting of Fe, Cu, Ni, and alloys thereof.

4. The assembly of claim 1 wherein the connector is a Ni/Ni ferrite cermet.

5. The assembly of claim 1 wherein the anode is a Ni/Ni ferrite cermet.

6. The assembly of claim 1 wherein the anode is hollow.

7. The assembly of claim 1 wherein the connector and anode are joined in a region of high temperature in a hollow anode.

8. The assembly of claim 1 wherein the connector is a Ni/Ni ferrite cermet having from 15 to 50% by volume of Ni.

9. The assembly of claim 1 wherein the connector is a Ni/Ni ferrite cermet having from 30 to 50% by volume Ni.

10. The assembly of claim 1 wherein the connector is a cermet having no more than 8% by volume porosity.

11. The assembly of claim 1 comprising a 16/84 vol. % Ni/Ni ferrite cermet anode and a 40/60 vol. % Ni/Ni ferrite cermet connector.

12. The assembly of claim 11 wherein the connector has an electrical resistivity of not more than $1\times10^{-3}$ ohm-cm.

13. The assembly of claim 1 wherein the anode is MnZn ferrite and the connector is a Ni/MnZn ferrite cermet.

14. An anode assembly for a Hall cell comprising a Ni/Ni ferrite cermet anode connector having an electrical resistivity at the operating temperature of the cell less than the anode and not more than $1\times10^{-3}$ ohm-cm consisting of 40% by volume of Ni and 60% by volume of Ni ferrite and a Ni/Ni ferrite anode having 16% by volume Ni and 84% by volume of Ni ferrite, said connector and anode threaded together in the green or calcined state before sintering to form said assembly.

* * * * *